US008752690B2

(12) United States Patent
Ikegami et al.

(10) Patent No.: US 8,752,690 B2
(45) Date of Patent: Jun. 17, 2014

(54) BILL DEPOSITING/WITHDRAWING MACHINE

(75) Inventors: Katsumi Ikegami, Gunma (JP); Youichi Norota, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/807,914

(22) PCT Filed: Jul. 28, 2011

(86) PCT No.: PCT/JP2011/067243

§ 371 (c)(1),
(2), (4) Date: Dec. 31, 2012

(87) PCT Pub. No.: WO2012/049902

PCT Pub. Date: Apr. 19, 2012

(65) Prior Publication Data

US 2013/0105271 A1 May 2, 2013

(30) Foreign Application Priority Data

Oct. 14, 2010 (JP) ..... 2010-231655

(51) Int. Cl.
*G07D 7/00* (2006.01)
*G07F 7/04* (2006.01)

(52) U.S. Cl.
USPC ..... 194/302

(58) Field of Classification Search
USPC ..... 194/206, 207, 302; 209/534; 235/379
See application file for complete search history.

(56) References Cited

U.S. PATENT DOCUMENTS

| | | | | |
|---|---|---|---|---|
| 2002/0074267 | A1* | 6/2002 | Mukai | 209/534 |
| 2005/0056519 | A1* | 3/2005 | Yokoi et al. | 194/206 |
| 2008/0044077 | A1* | 2/2008 | Mennie et al. | 382/135 |

FOREIGN PATENT DOCUMENTS

| | | | |
|---|---|---|---|
| EP | 1632909 | A1 | 3/2006 |
| EP | 1868167 | A2 | 12/2007 |
| JP | 61-294596 | A | 12/1986 |
| JP | 63-024390 | A | 2/1988 |
| JP | 63-234384 | A | 9/1988 |
| JP | 6-162310 | A | 6/1994 |
| JP | 2010-152722 | A | 7/2010 |
| RU | 2206125 | C2 | 6/2003 |

* cited by examiner

*Primary Examiner* — Mark Beauchaine
(74) *Attorney, Agent, or Firm* — Rabin & Berdo, P.C.

(57) ABSTRACT

Bills are fed from a customer serving section to a discriminator according to continuous feeding, and the discriminator reads identification information of the bills to store the identification information in an identification information storage. When the discriminator discriminates a bill, it determines whether or not the same identification information as the identification information of the bill is stored in the identification information storage. If the same identification information is stored, the customer serving section feeds the bills to the discriminator according to intermittent feeding. This prevents any bill from being undiscriminated.

5 Claims, 16 Drawing Sheets

FIG. 9

| STEP | BILL POSITION | | | | | | | | | | | | | | | | | | | | |
|---|---|---|---|---|---|---|---|---|---|---|---|---|---|---|---|---|---|---|---|---|---|
| | M1 | M2 | M3 | M4 | M5 | M6 | M7 | M8 | M9 | M10 | M6 | M5 | M4 | M10 | M9 | M8 | M9 | M10 | M4 | M8 | M4 |
| T0 | A | A | A | A | A | A | A | A | A | A | | | | | | | | | | | |
| T1 | E | E | D | C | B | B | A | A | A | A | | | | | | | | | | | |
| T2 | E | E | E | E | E | E | A | A | A | A | | | | | | | | | | | |
| T3 | E | E | E | | | | A | A | A | A | A | A | A | | | | | | | | |
| T4 | E | E | E | | | | D | C | B | B | A | A | A | | | | | | | | |
| T5 | E | E | E | | | | E | E | E | E | A | A | A | | | | | | | | |
| T6 | E | E | E | | | | E | | | | A | A | A | A | A | A | | | | | |
| T7 | E | E | E | | | | E | | | | E | D | C | B | B | A | | | | | |
| T8 | E | E | E | | | | E | | | | E | E | E | E | E | A | | | | | |
| T9 | E | E | E | | | | E | | | | E | E | | | | A | A | A | A | | |
| T10 | E | E | E | | | | E | | | | E | E | | | | C | A | A | A | | |
| T11 | E | E | E | | | | E | | | | E | E | | | | | A | A | A | A | |
| T12 | E | E | E | | | | E | | | | E | E | | | | | C | A | A | A | |
| T13 | E | E | E | | | | E | | | | E | E | | | | | E | C | A | A | |
| T14 | E | E | E | | | | E | | | | E | E | | | | | E | E | C | A | |
| T15 | E | E | E | | | | E | | | | E | E | | | | | E | E | | A | A |
| T16 | E | E | E | | | | E | | | | E | E | | | | | E | E | | C | A |

FIG. 22

| STEP | BILL POSITION | | | | | | | | | | | | | | | | | | | | |
|---|---|---|---|---|---|---|---|---|---|---|---|---|---|---|---|---|---|---|---|---|---|
| | M1 | M2 | M3 | M4 | M5 | M6 | M7 | M8 | M9 | M10 | M4 | M5 | M6 | M8 | M9 | M10 | M4 | M5 | M6 | M8 | M4 |
| T0 | A | A | A | A | A | A | A | A | A | A | | | | | | | | | | | |
| T1 | E | E | D | C | B | B | A | A | A | A | | | | | | | | | | | |
| T2 | E | E | E | | | | A | A | A | A | A | A | A | | | | | | | | |
| T3 | E | E | E | | | | D | C | B | B | A | A | A | | | | | | | | |
| T4 | E | E | E | | | | E | | | | A | A | A | A | A | A | | | | | |
| T5 | E | E | E | | | | E | | | | C | B | B | A | A | A | | | | | |
| T6 | E | E | E | | | | E | | | | | | | A | A | A | A | A | A | | |
| T7 | E | E | E | | | | E | | | | | | | C | A | A | A | A | A | | |
| T8 | E | E | E | | | | E | | | | | | | | A | A | A | A | A | A | |
| T9 | E | E | E | | | | E | | | | | | | | C | A | A | A | A | A | |
| T10 | E | E | E | | | | E | | | | | | | | E | C | A | A | A | A | |
| T11 | E | E | E | | | | E | | | | | | | | E | E | C | A | A | A | |
| T12 | E | E | E | | | | E | | | | | | | | E | E | | A | A | A | A |
| T13 | E | E | E | | | | E | | | | | | | | E | E | | C | A | A | A |
| T14 | E | E | E | | | | E | | | | | | | | E | E | | E | C | A | A |
| T15 | E | E | E | | | | E | | | | | | | | E | E | | E | E | C | A |

BILL DEPOSITING/WITHDRAWING MACHINE

TECHNICAL FIELD

The present invention relates to a bill depositing/withdrawing machine, and more specifically to a depositing/withdrawing machine included in automatic transaction apparatuses such as automated teller machines or automatic ticket vending machines, which perform bill deposit process.

BACKGROUND ART

For example, as disclosed in Japanese Patent Laid-Open Publication No. 2010-152722, in a conventional deposit process in depositing/withdrawing machines, first, bills inserted into a deposit/withdrawal slot are sequentially fed to a discriminator one by one to be discriminated there. If, in the discriminator, detected is an abnormal bill such as a bill getting close to another bill or being conveyed obliquely than allowed, or a counterfeit or damaged bill, then the abnormal bill is conveyed to the deposit/withdrawal slot. At this time, together with the abnormal bill, some bills following the abnormal bill are also conveyed to the deposit/withdrawal slot. In the deposit/withdrawal slot, there is no separator for differentiating between the bills inserted and not yet fed to the discriminator and the bills having passed the discriminator and then returned to the deposit/withdrawal slot. Therefore, the returned bills to the deposit/withdrawal slot will continuously be fed again to the discriminator without being discriminated from the other bills in the deposit/withdrawal slot.

For that reason, when, for example, a plurality of abnormal bills are contained in the bills inserted into the deposit/withdrawal slot, or even when only one abnormal bill is contained depending on how to transfer the bills in the depositing/withdrawing machine, there would remain a bill which is not subjected to discrimination by the discriminator. Such a bill will be returned to the deposit slot together with the abnormal bill before being discriminated by the discriminator.

SUMMARY OF THE INVENTION

It is an object of the present invention to solve the disadvantage in the conventional art to provide a depositing/withdrawing machine, where no bill remains undiscriminated even when bills inserted into a deposit/withdrawal slot contain a plurality of abnormal bills.

A depositing/withdrawing machine of the present invention includes a bill inlet section into which a bill is inserted; a feeder for feeding the bill one by one from the bill inlet section to a bill conveyance channel; a discriminator for discriminating the conveyed bill; and an accumulator for accumulating in the bill inlet section the bill conveyed to the bill inlet section, and when an abnormal bill is detected by the discriminator, an undiscriminated bill on the bill conveyance channel is accumulated in the bill inlet section together with the abnormal bill. The depositing/withdrawing machine further includes an identification information reader for reading identification information of a bill; an identification information storage for storing the read identification information; and a controller for controlling how the feeder conveys a bill. The controller determines whether or not the identification information of the bill discriminated as an abnormal bill in the discriminator is already stored in the identification information storage. If the identification information is stored, the controller controls the feeder such that, after the bill conveyed from the bill inlet/outlet is discriminated by the discriminator, one bill following the discriminated bill is allowed to be fed to the bill conveyance channel.

BRIEF DESCRIPTION OF THE DRAWINGS

The objects and features of the present invention will become more apparent from consideration of the following detailed description taken in conjunction with the accompanying drawings in which:

FIG. 9 is an explanatory view showing a time-series behavior of the position of the bill in the deposit process in the embodiment shown in FIG. 1;

FIG. 22 is an explanatory view showing alternative time-series behavior of the position of the bill in deposit process in the embodiment shown in FIG. 1.

BEST MODE FOR IMPLEMENTING THE INVENTION

Figure 1:
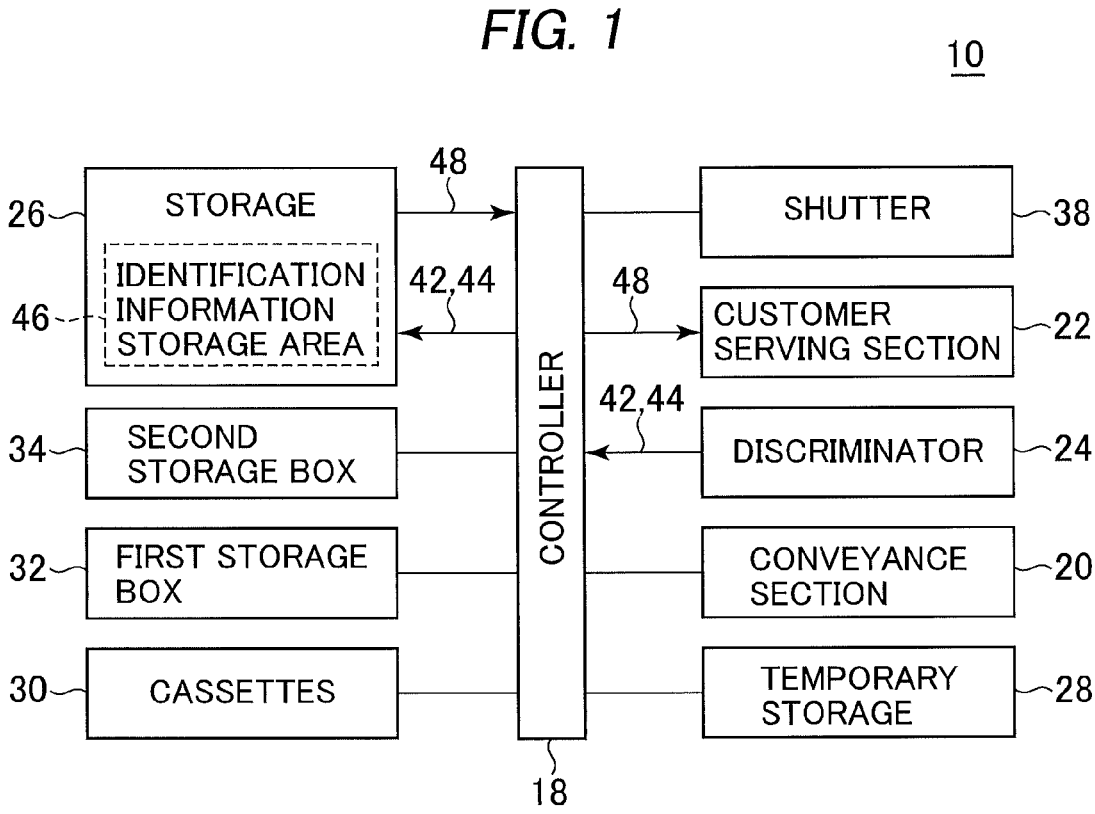
FIG. 1 is a block diagram showing a schematic configuration of a depositing/withdrawing machine according to the present invention.

An embodiment of a depositing/withdrawing machine according to the present invention will be described in detail with reference to the accompanying drawings. FIG. 1 shows a depositing/withdrawing machine 10 in accordance with the embodiment. The depositing/withdrawing machine 10 is provided in automatic transaction apparatuses such as automated teller machines or automatic ticket vending machines and adopted to perform bill deposit and withdrawal process and the like. The depositing/withdrawing machine 10 may perform only the bill deposit process.

In the context, the deposit process refers to a process such as counting bills inserted by the customer and storing the bills in a storage in the depositing/withdrawing machine. The withdrawal process herein refers to a process for counting the bills stored in the storage and delivering the bills to the customer.

Figure 2:
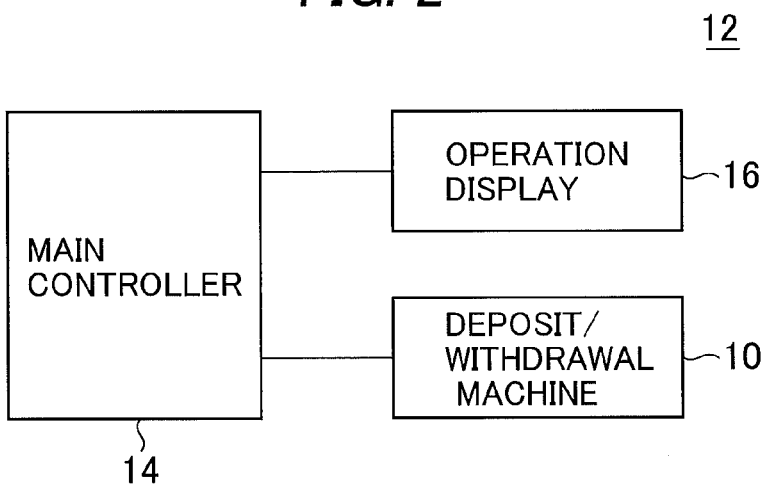
FIG. 2 is a block diagram showing a schematic configuration of a transaction apparatus including the depositing/withdrawing machine shown in FIG. 1.

In addition to the depositing/withdrawing machine 10, an automatic transaction apparatus 12 of the instant embodiment includes, as shown in FIG. 2, a main controller 14 connected to the machine 10 and an operation display 16. The main controller 14 is adopted to control the whole of the automatic transaction apparatus 12, and includes a calculation and control means such as a central processing unit (CPU). The main controller 14 also includes a memory and a magnetic disc drive or the like for storing control program sequences to control the depositing/withdrawing machine 10 in response to the control program sequences. The operation display 16 is connected to the main controller 14 and has a screen on which a guidance of operation is displayed to the customer and is adapted to accept the operations.

Figure 3:
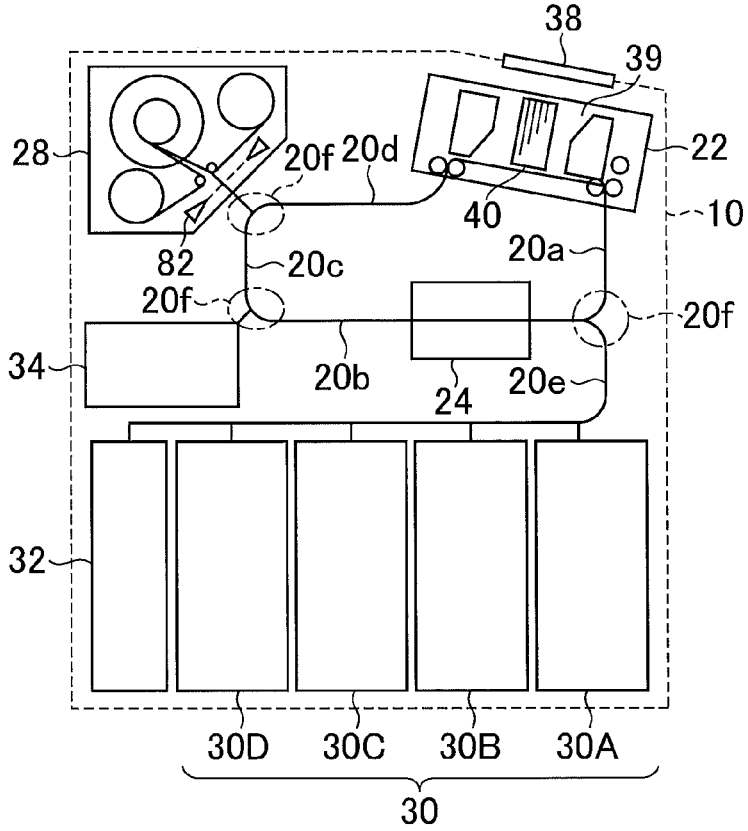
FIG. 3 is a side sectional view showing a schematic configuration of the depositing/withdrawing machine shown in FIG. 1.

As shown in FIGS. 1 and 3, the depositing/withdrawing machine 10 of the embodiment includes a controller 18, a conveyance section 20, a customer serving section 22, a discriminator 24, a memory 26, a temporary storage 28, cassettes 30, a first storage box 32, a second storage box 34, a memory 36 and a shutter 38, which are interconnected as illustrated. In the depositing/withdrawing machine 10 in the embodiment, generally, bills 40 are inserted into the deposit/withdrawal slot in the customer serving section 22 and then conveyed to the discriminator 24 and discriminated there one by one to be delivered to the temporary storage 28. After discrimination of all of the bills, the bills are stored in the cassettes 30 according to the denominations of the bills. However, some bills may appropriately be returned from the discriminator 24 or the temporary storage 28 to the customer serving section 22, or may be stored in the first or second storage box 32 or 34.

The components of the machine 10 of the embodiment will be described in more detail.

The controller 18 serves as controlling at least whole operations of the depositing/withdrawing machine 10. Of course, the depositing/withdrawing machine 10 may exclude the controller 18 and the main controller 14 may be adapted to control the whole operations of the depositing/withdrawing machine 10.

The conveyance section 20 serves as conveying the bills to the sections of the depositing/withdrawing machine. The conveyance section 20 includes conveyance channels 20*a*, 20*b*, 20*c*, 20*d* and 20*e* and a switch blade 20*f*. The conveyance channels 20*a*, 20*b*, 20*c* and 20*d* extend from the customer serving section 22 to the customer serving section 22 through the discriminator 24. The conveyance channel 20*e* extends from the discriminator 24 to the cassettes 30 and first storage box 32. The conveyance channels have branch points, from which the bills can go toward the second storage box 34, the temporary storage 28 and the like.

The channel 20*a* connects the deposit/withdrawal slot in the customer serving section 22 to the discriminator 24, and the channel 20*b* connects the discriminator 24 to the branch point for the second storage box 34. The channel 20*c* connects the branch point for the second storage box 34 to the branch point for the temporary storage 28, and the channel 20*d* connects the branch point for the temporary storage 28 to the deposit/withdrawal slot.

The switch blade 20*f* is provided at the branch point of the conveyance channel. Control of the switch blade causes the bills to be conveyed to different destinations.

The conveyance channels 20*a* to 20*e* of the embodiment nip the bills with pairs of belts or rollers against the opposite surfaces thereof to convey them. The conveyance channels 20*a* to 20*e* of the embodiment are driven by a driving means such as a motor, which may be controlled so as to cause the bills to be adjusted in terms of the direction and speed of conveyance.

The customer serving section 22 is adapted for receiving the bills 40 inserted from the deposit/withdrawal slot by the customer, and for delivering to the customer bills to be returned to the customer, that is, bills to be withdrawn by the customer or bills discriminated abnormal one or ones of the bills 40 inserted by the customer. The customer serving section 22 also serves as individually feeding bills from the deposit/withdrawal slot to the conveyance channel 20*a* and taking bills conveyed on the conveyance channel 20*d* thereinto.

The discriminator 24 serves as discriminating and counting bills. The discriminator of the embodiment includes an optical sensor of charge-coupled device (CCD), by using which the images or the like of the opposite sides of a bill can be captured in the form of image data, which will be compared with the image data or the like registered in advance in a database for discrimination of bills to thereby verify the genuineness, damage, denomination and the like of the bills. The discriminator 24 of the embodiment also detects a conveyance abnormality on the conveyance and intervals between the bills passing through the discriminator. Of course, the discriminator 24 may include any types of sensor, such as a magnetic sensor, other than the CCD sensor to obtain the image data of bills. A bill the discriminator 24 determines as a counterfeit or abnormally conveyed bill will be referred to as an abnormal bill.

The discriminator 24 of the embodiment further includes an identification information reader which reads identification information for identifying an individual bill from bill image data obtained by the CCD sensor or the like. In the embodiment, the identification information is a serial number printed specifically on each bill. The read serial number 44 is used as the bill identification information.

The serial number is a string of characters including alphanumerics, which is specifically assigned in advance to, and printed on, each bill.

The discriminator 24 sends a discrimination result 42, a counting result and the serial number 44 to the controller 18 which in turn sends the discrimination result 42 and serial number 44 to the memory 26.

The discriminator 24 may be adapted only to obtain the image data, and the controller 18 may be adapted to use the obtained image data to discriminate the bills and read the serial number. In this case, the identification information reader may be included in the controller 18.

The memory 26 includes a memory device, a magnetic disc drive or the like, and serves as storing the discrimination result 42 and counting result from the discriminator 24. The memory 26 may store various control program sequences (software) for controlling the entire automatic transaction apparatus 12. The memory 26 also stores information on the denomination, damage and number of the bills discriminated by the discriminator 24, together with their order in storing them in the temporary storage.

The memory 26 of the embodiment includes an identification information storage area 46 where the serial numbers 42 are stored. The serial numbers 42 are stored in the order detected in the discriminator 24.

The memory 26 of the embodiment further stores setting information 48 on how bills are fed from the customer serving section 22 to the conveyance channel 20*a*. The information 48 will be referred to as "feeding information". The feeding manner is classified into "continuous feeding" and "intermittent feeding". Whenever the feeding information 48 in the memory 26 indicates the continuous feeding, the customer serving section 22 will continuously feed the bills to the conveyance channel 20*a*. When the feeding information 48 indicates the intermittent feeding, the customer serving section 22 will intermittently feed the bills to the conveyance channel 20*a*. The feeding information indicating the continuous feeding will be referred to simply as "continuous feeding", and the feeding information indicating the intermittent feeding simply as "intermittent feeding".

Well, the "continuous feeding" and the "intermittent feeding" will be described in more detail.

When the feeding information 48 is the "continuous feeding", the customer serving section 22 feeds individually the bills to the conveyance channel 20*a* at the predetermined minimum interval. The predetermined minimum interval is, in this embodiment, the interval for finishing the deposit process as fast as possible in consideration of time required to discriminate bills by the discriminator 24 and to switch the switch blade 20*f*, which may not be restrictive. In the case of the "continuous feeding", before the bill fed from the customer serving section 22 to the conveyance channel 20*a* is discriminated by the discriminator 24, one subsequent bill is fed from the customer serving section 22 to the conveyance channel 20*a*.

When the feeding information 48 is "intermittent feeding", the bill fed from the customer serving section 22 to the conveyance channel 20*a* is discriminated by the discriminator 20, and then one subsequent bill is fed from the customer serving section 22 to the conveyance channel 20*a*.

Therefore, when the bill fed from the customer serving section 22 is being discriminated by the discriminator 24, a plurality of subsequent bills exist on the conveyance channel 20*a* in the case of "continuous feeding", whereas in the case of "intermittent feeding" no subsequent bill exists on the conveyance channel 20*a*.

The temporary storage 28 serves as temporarily storing the bills inserted into the customer serving section 22 by the customer. The temporary storage 28 of the embodiment twines the bills around its drum with a winding tape or the like to thereby store them. The temporary storage 28 keeps twining the bills around the drum to temporarily store them until the customer finishes the deposit transaction by his or her operation, that is, until the deposited amount is confirmed. When, contrarily, the customer cancels the deposit transaction by his or her operation, the bills stored in the temporary storage 28 are returned to the customer serving section 22.

The cassettes 30 serve as storing bills. The cassettes 30 have stages provided therein which can be moved up and down by elevating mechanism. Bills to be stored are accumulated on the stages by the accumulation mechanism of the cassettes 30. The cassettes 30 also have feeding mechanism provided therein, by which the bills in the cassettes 30 can be individually fed out to the conveyance channel 20*e*. In the instant embodiment, the cassettes 30 include cassettes 30A, 30B, 30C and 30D, which have the same configuration as each other.

The first storage box 32 serves as storing bills of denomination which is not used in transactions with the customer among the bills inserted into the customer serving section 22, for example, 2000-yen or 5000-yen bills. The first storage box 32 can accumulate such bills of denomination conveyed on the conveyance channel.

The second storage box 34 serves as storing the bills remaining in the customer serving section 22 at the time when the deposit or withdrawal process is finished. For example, in the withdrawal process, when the customer has left some or all of the bills piled up on the customer serving section 22, the second storage box 34 stores the left bills.

The shutter 38 is arranged at the top of the deposit/withdrawal slot to release the deposit/withdrawal slot when the customer inserts bills or takes bills out, and to close the deposit/withdrawal slot when bills are taken into the depositing/withdrawing machine 10. In this embodiment, the shutter 38 is a sliding type of shutter arranged to be reciprocally movable in the directions perpendicular to the direction in which bills are conveyed by a pick-up roller, described later, in the customer serving section 22.

Now, the customer serving section 22 of the embodiment will be described in more detail with reference to FIGS. 4 and 5. The customer serving section 22 of the embodiment includes a deposit/withdrawal slot 39, a feeder 50, a supporting plate 52, a pool guide 54, a bill press 56, a side plate 58 and an accumulator 60.

The feeder 50 serves as feeding individually the bills 40 in the deposit/withdrawal slot to a conveyance channel 32*a* and returning a bill located at the inlet end of the conveyance channel 32*a* into the deposit/withdrawal slot, and includes a pick-up roller 62, a feed roller 64 and a separating roller 66.

The pick-up roller 62 serves as forcing bills that are vertically supported on the supporting plate 52 toward the feed roller 64 and separating roller 66, and also forcing bills delivered from the feed roller 64 and separating roller 66 onto the supporting plate 52.

The pick-up roller 62 includes a pick-up roller shaft 62*a* and is configured such that it rotates forward or backward about the shaft 62*a*. The pick-up roller 62 is arranged at the side of the deposit/withdrawal slot 39 above the supporting plate 52. The pick-up roller 62 has a highly frictional member, such as rubber, having its frictional factor larger and attached to part of the outer circumferential surface of the roller 62 whereby the pick-up roller 62 can readily take out and pull in the bills.

The feed roller 64 constitutes a gate 67 together with the separating roller 66, and serves as further delivering the bills delivered from the pick-up roller 62 to the conveyance channel 20*a* in the direction indicated by an arrow E and also as delivering the bills located at the inlet end of the conveyance channel 20*a* to the pick-up roller 62.

The feed roller 64 includes a feed roller shaft 64*a*, and is configured such that it can rotate forward and backward about the shaft 64*a*. The feed roller 64 is arranged in the vicinity of the end of the support plate 52 and downstream the pick-up roller 62 in the direction of the arrow E in which the feeder 50 conveys the bills.

The feed roller 64 has a highly frictional member attached to part of the outer circumferential surface of the roller 64, by which member the feed roller 64 can easily carry the bills into and out of the deposit/withdrawal slot 39. The feed roller 64 also has two ring-like grooves provided in parallel with each other over the entire circumference of the feed roller 64.

The pick-up roller 62 and feed roller 64 are connected to each other with a power transmission mechanism such as a gear row, and with rotation of the feed roller 64, the pick-up roller 62 rotates in the same direction at the same rate.

The separating roller 66 is arranged opposed to the feed roller 64 and has one groove provided over the entire outer circumference of the separating roller 66, the groove engaging with a projection between the grooves in the feed roller 64. The separating roller 66 includes a separating roller shaft 66*a* and is configured such that it rotates about the shaft 66*a* in one direction. The separating roller 66 rotates with the feed roller 64 when carrying the bills into the deposit/withdrawal slot 39, whereas when carrying the bills out of the deposit/withdrawal slot 39, the roller 66 does not rotate.

Figure 4:
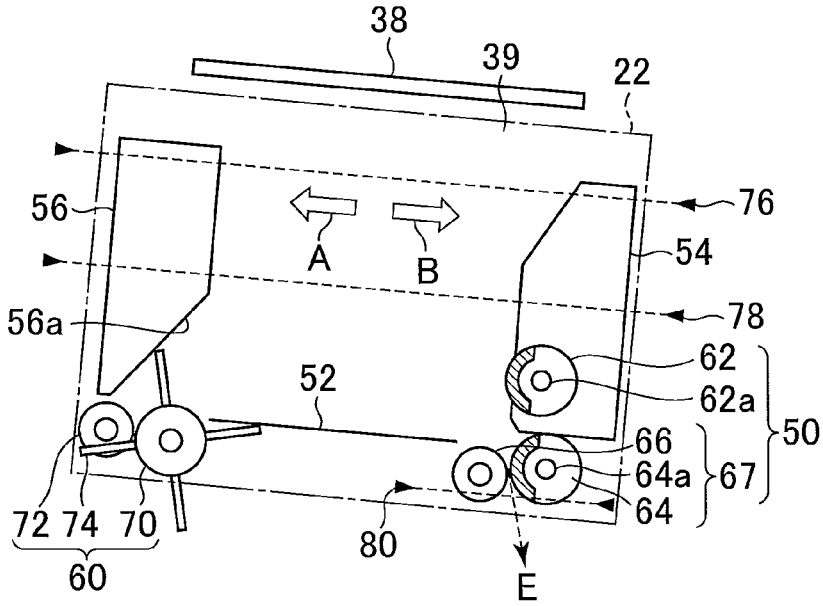
FIG. 4 is a side sectional view showing a schematic configuration of a customer serving section shown in FIG. 1.
Figure 5:
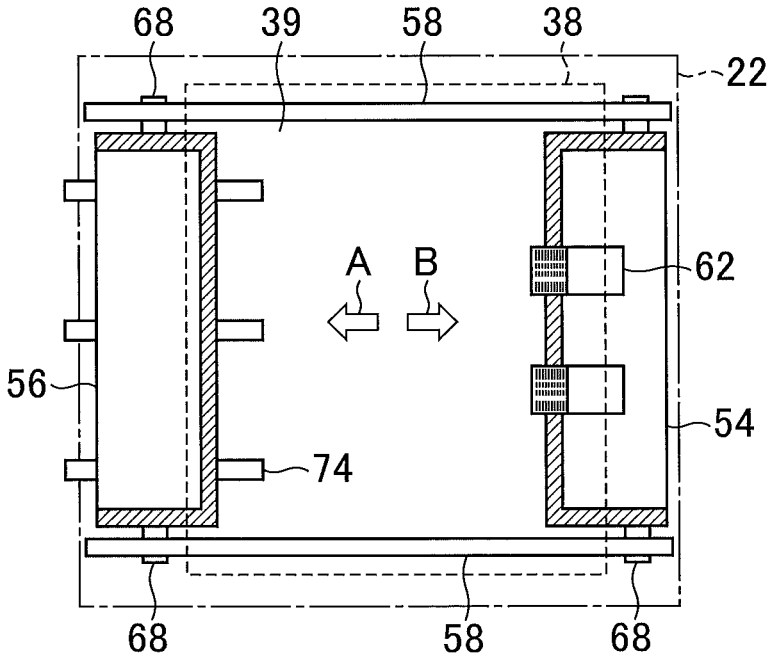
FIG. 5 is a plan view showing a schematic configuration of the customer serving section shown in FIG. 1.

The pool guide 54 is arranged on the side of the pick-up roller 62 in the deposit/withdrawal slot 39, and can reciprocally move in directions perpendicular to the direction in which the pick-up roller conveys bills out, that is, the directions of arrows A and B in FIGS. 4 and 5. The pool guide 54 has its opening provided whereby the movement of the pool guide 54 is not disturbed by the pick-up roller 62.

The bill press 56 is a thick plate arranged on the opposite side to the pick-up roller 62 in the deposit/withdrawal slot 39. The thick plate is trapezoidal when viewed from the side of the plate as shown in FIG. 4. The bill press 56 is arranged opposed to the pool guide 54 such that it can reciprocally move in the directions of arrows A and B in FIGS. 4 and 5. The bill press 56 is also configured to rotate about its rotational axis. The bill press 56 further has an inclined surface 70*a* formed on the surface facing the pick-up roller 62. The inclined surface 70*a* is inclined so as to become away from the pool guide 54 as getting closer to the support plate 52.

At the respective side surfaces of the pool guide 54 and bill press 56, guiding parts 68 are arranged, respectively, which fit into a guide provided in the side plate 58 so as to be slidable on the guide. The guiding parts 68 in the instant embodiment move the pool guide 54 and bill press 56 via a motor, a belt and the like. Accordingly, the moving distance and position of the pool guide 54 and bill press 56 in the embodiment can be managed by the rotational control of the stepping motor or an encoder attached to the rotational shaft of the motor.

The accumulator 60 serves as taking the bills, conveyed from the conveyance channel 20*d* to the customer serving section 22, into the deposit/withdrawal slot 39. The accumulator includes an accumulation roller 70, a pressure roller 72 and an impeller 74.

The accumulation roller 70 works together with the pressure roller 72 to serve as conveying the bills conveyed on the conveyance channel 20*d* toward the pool guide 54. The accumulation roller 70 can rotate about an accumulation roller shaft and is arranged in the vicinity of the end of the supporting plate 52 on the opposite side to the feed roller 64 as shown in FIG. 4.

The pressure roller 72 is arranged opposed to the accumulation roller 70 and can rotate about the pressure roller shaft.

The impeller 74 is arranged alongside the accumulation roller 70 as shown in FIG. 4. When the accumulation roller and pressure roller 72 take the bill into the deposit/withdrawal slot, the impeller 74 hits the lower end of the bill whereby the bill can follow the pool guide 54 alone or together with other bills.

The depositing/withdrawing machine 10 in the embodiment further includes a hand insertion detecting sensor 76, a bill presence detecting sensor 78, a passage detecting sensor 80 and a delivery detecting sensor 82, which will be described below.

As shown in FIG. 4, the hand insertion detecting sensor 76 is provided in the customer serving section 22 and configured of a plurality of optical sensors to serve as detecting a hand or the like of the customer when the customer inserts bills into, or takes the withdrawn or returned bills out of, the deposit/withdrawal slot 39.

The bill presence detecting sensor 78 is arranged in the customer serving section 22 as shown in FIG. 4 and serves as detecting whether or not a bill exists in the deposit/withdrawal slot 39.

The passage detecting sensor 80 is arranged in the customer serving section 22 as shown in FIG. 4 and serves as monitoring passage of bills, delivered to the conveyance channel 20*a* by rotation of the pick-up roller 62 and feed roller 64, through the gate 67, and as counting the bills passing through the gate 67. Note that when the sensor 80 detects a bill, the bill is deemed as nipped between the feed roller 64 and the separating roller 66 with its portion protruding toward the conveyance channel 20*a*.

The delivery detecting sensor 82 is arranged in the temporary storage 28 as shown in FIG. 3, and serves as monitoring passage of the bills taken from the conveyance channel 20*c* into the temporary storage 28.

In addition to the above components, the depositing/withdrawing machine 10 in the present embodiment also has other components such as a transfer monitor and a solenoid for the switch blade in the conveyance section. However, they are not related to understanding the present invention and hence will not be described specifically in order to avoid redundancy.

Additionally, if necessary, a device for changing the orientation of the bills may be provided at some midpoint on the conveyance channel 20*d* or any other suitable position. The device for changing the orientation turns a bill upside down, when having passed through the discriminator 24 and returning to the deposit/withdrawal slot 39, so as to be stored in the deposit/withdrawal slot 39 accordingly. That makes it possible to obtain, when that bill is returned with its orientation changed to the discriminator 24 for discrimination, information which could not be acquired in the previous discrimination.

Next, the deposit process in the depositing/withdrawing machine 10 in the embodiment will be described with reference to FIGS. 6A to 6*d*.

Figure 7:
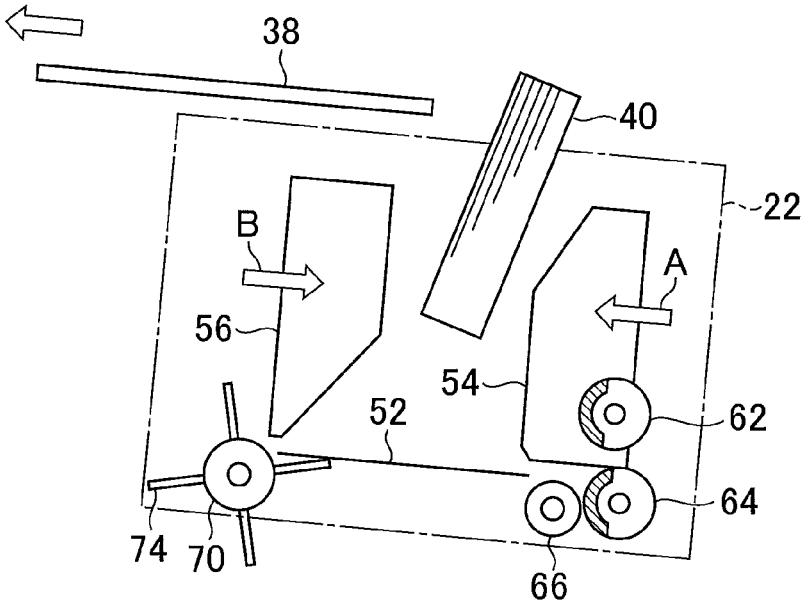
FIG. 7 is a side sectional view of the customer serving section for use in describing operations in the customer serving section when a bill is inserted into a deposit/withdrawal slot in the embodiment shown in FIG. 1.

First, when the customer selects the "deposit" transaction by means of the operation display 16, the pool guide 54 and bill press 56 in the customer serving section 22 move approximately to the center of the deposit/withdrawal slot 39 as shown in FIG. 7, and the shutter 38 is opened. Thus, the customer can place the bills 40 in the deposit/withdrawal slot 39. The positions the pool guide and bill press take when the customer places bills in the deposit/withdrawal slot will be referred to as an "insertion position". When starting the deposit process, the customer may insert a bankbook or a cash card into a processing section, which is not shown.

When the "deposit" transaction is selected, the controller 18 stores the "continuous feeding" as the feeding information 48 in the memory 26 (step S1). At this time, the identification information storage area 46 is initialized.

The bills 40 inserted into the deposit/withdrawal slot 39 are sensed by the sensor 78 (step S1). When the hand of the customer has become not sensed by the sensor 76, following the bills being sensed by the sensor 78, it is determined that the bills insertion by the customer is finished, and the shutter 38 is in turn closed (step S2).

Figure 8:
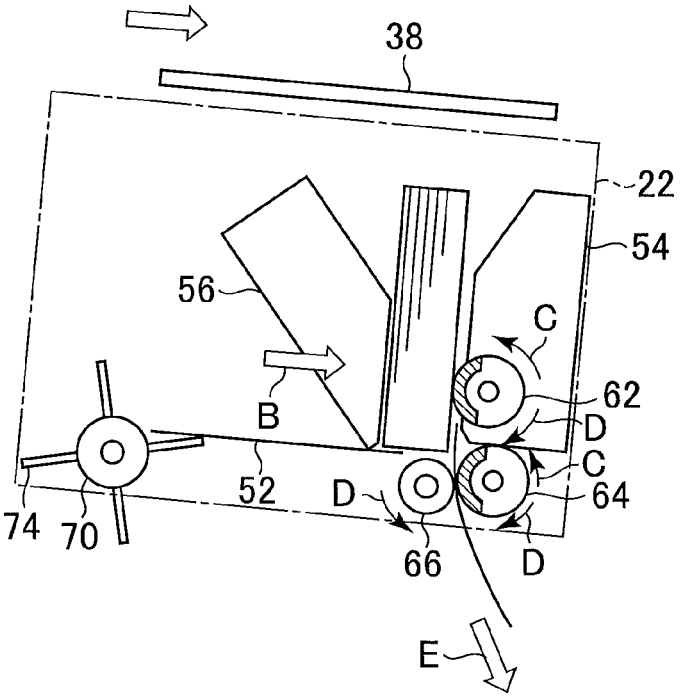
FIG. 8 is a side sectional view of the customer serving section for use in describing operations of the customer serving section when the bill is fed to a conveyance channel in the embodiment shown in FIG. 1.

When the closure of the shutter 38 is sensed by a sensor, not shown, the bill press 56 moves in the direction indicated by the arrow B, FIG. 8, whereby the bills are nipped by the bill press 56 and the pool guide 54, and the feeder 50 moves the bills 40 to a position where the bills 40 can be fed to the conveyance channel 20*a*. That position will be referred to as "feeding position". The bill press 56 is rotated in the vicinity of the feeding position by a rotating mechanism, not shown, and the inclined surface 56*a* of the bill press rises with respect to the supporting plate 52 whereby the bills 40 are pressed onto the pick-up roller 62 by the inclined surface 56*a* as shown in FIG. 8 (step S3).

When the bills 40 are pressed onto the pool guide 54 at the feeding position, the pick-up roller 62 and feed roller 64 rotate in the direction indicated by the arrow C in FIG. 8 in order to start to send individually the bills to the conveyance channel 20. At the same time, the conveyance section 20 activates the components of the conveyance section 20 including the conveyance channels 20*a* to 20*c*.

In this example, since memory 26 stores the "continuous feeding" as the feeding information, the feeder 50 feeds the bills 40 to the conveyance channel 20*a* according to the continuous feeding (step S4). Since there is no bill preceding the first bill in the deposit/withdrawal slot 39, the first bill is immediately fed to the conveyance channel 20*a* once it becomes ready to be fed to the conveyance channel 20*a*.

The bill fed from the customer serving section 22 to the conveyance channel 20*a* reaches the discriminator 24.

The discriminator 24 discriminates the bill and reads its serial number (step S5). The discrimination result 42 and serial number 44 acquired by the discriminator 24 are informed to the controller 18. The serial number 44 is stored in the storage area 46 in the memory 26 in the order in which the discriminator 24 has discriminated (step S6).

The controller 18 determines whether or not the bill in the discriminator 24 is abnormal on the basis of the discrimination result 42 (step S7). If, in step S7, the discrimination result 42 does not indicate an abnormal bill (NO), then the bill is conveyed to the temporary storage 28 (step S8). It is then determined whether or not there is a bill in the deposit/withdrawal slot 39 by using the sensor 78, that is, whether or not the feeding of the bills has completed (step S9). If not completed (NO), the procedure returns to step S4. If completed, a resultant count of the bills is displayed on the operation display 16 (step S10). For example, when the customer inserts ten 10000-yen bills into the deposit/withdrawal slot, a message "100,000 yen deposited on account" is displayed on the operation display 16 to require the customer to confirm the counting result.

If the customer confirms the counting result (step S11) and depresses a confirmation button on the operation display 16 to accept the counting result (OK), then all of the bills stored in the temporary storage 28 will be delivered to their relevant cassettes 30A, 30B, 30C and 30D over the conveyance channel 20*c*, 20*b* and 20*e* (step S12). The deposit process will be finished.

Note that a bill, when discriminated by the discriminator 24 as unsuitable one for deposits or withdrawal (for example, a 2000-yen bill or a 5000-yen bill) rather than normal or counterfeit ones, may be stored in the first storage box 32.

If the customer depresses a cancellation button on the operation display to express non-acceptance of the counting result in step S11 (NG), then a process for cancelling the deposit will start.

First, the pool guide and bill press are moved toward the accumulation roller to be ready to receive withdrawn bills (step S13).

Next, all bills stored in the temporary storage 28 are fed to the conveyance channel 22*d* and delivered to the customer serving section 22 so as to be accumulated in the deposit/withdrawal slot 39 (step S14). At this time, the sensor 78 senses the bill taken first.

When all of the bills have been accumulated in the deposit/withdrawal slot, the shutter 38 is opened. When the customer takes the bills from the deposit/withdrawal slot 39, the sensor 76 senses that and the shutter will be closed (step S15).

Note that so far as the sensor 78 senses a bill, a message "Take bills" is continuously displayed on the operation display 16 without closing the shutter 38 in a certain period.

In step S11, if the confirmation button is depressed, it is determined that deposit is established, so that the bankbook may be filled in, the balance may be updated and the medium (the bankbook or cash card) may be returned. Description thereof is refrained from.

Figure 6A:
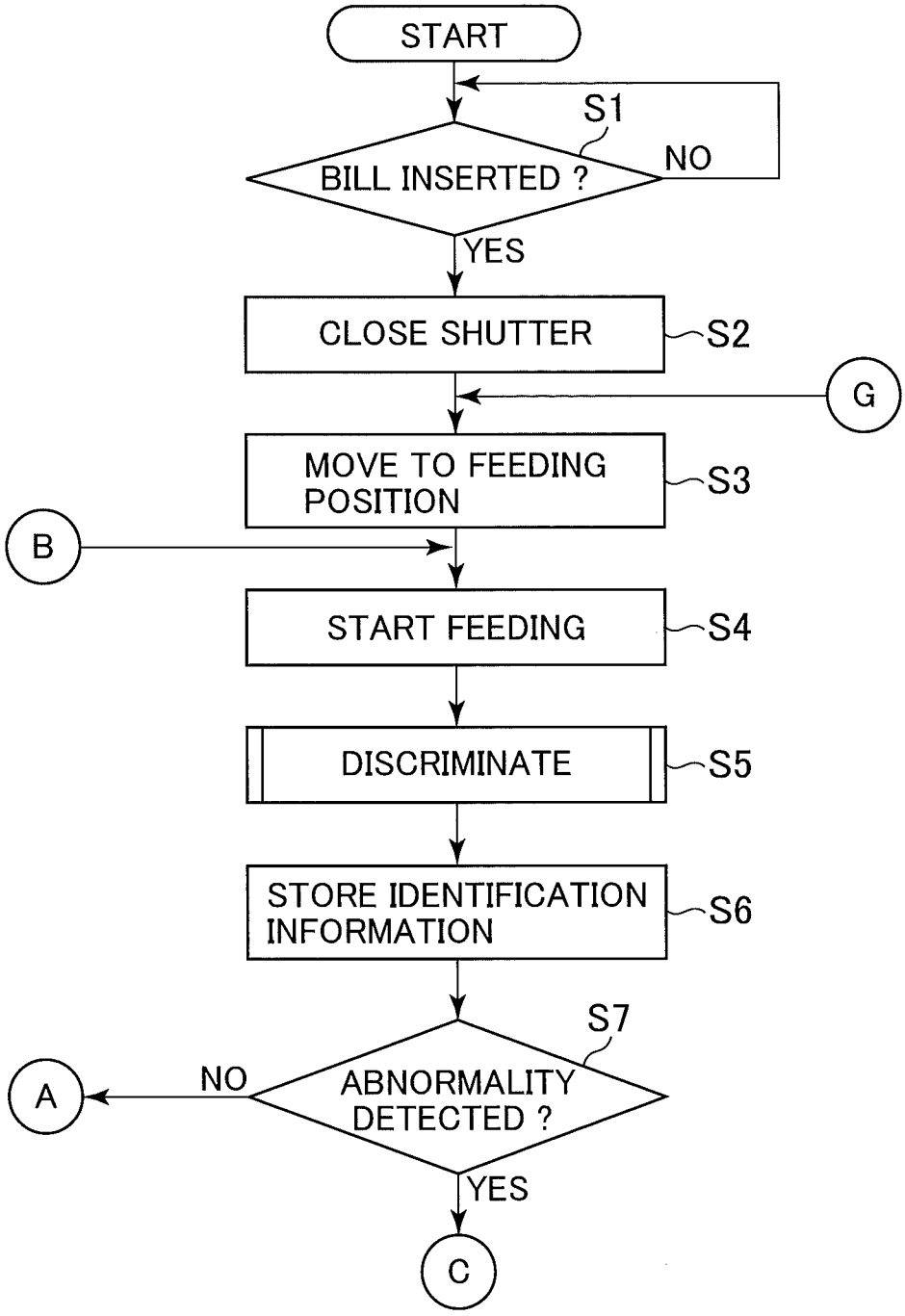
FIG. 6A is a flow chart showing a procedure for detecting an abnormal bill in deposit process of the embodiment shown in FIG. 1.
Figure 6B:
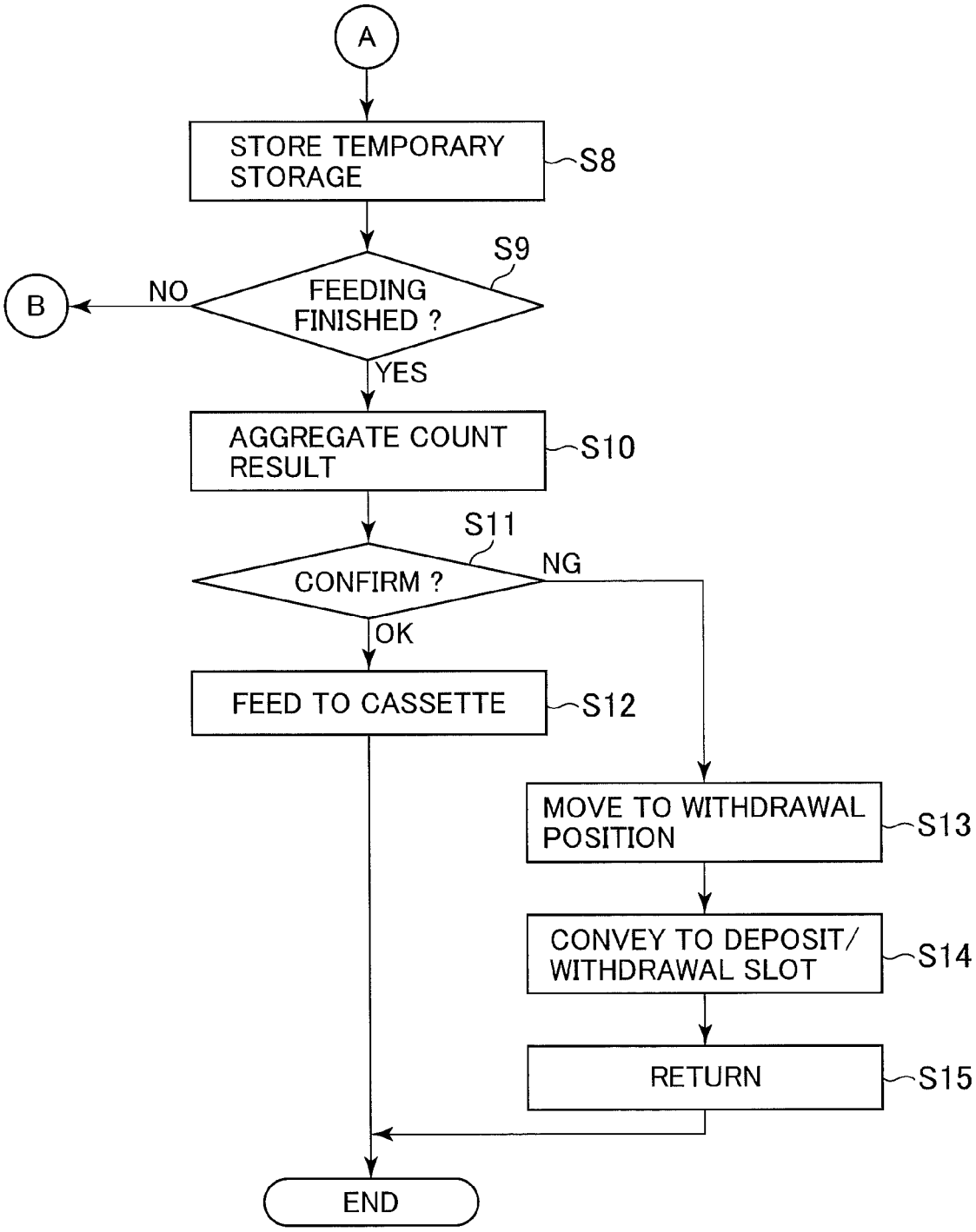
FIG. 6B is a flow chart showing an operational procedure, following FIG. 6A, for storing or returning the bill.
Figure 6C:
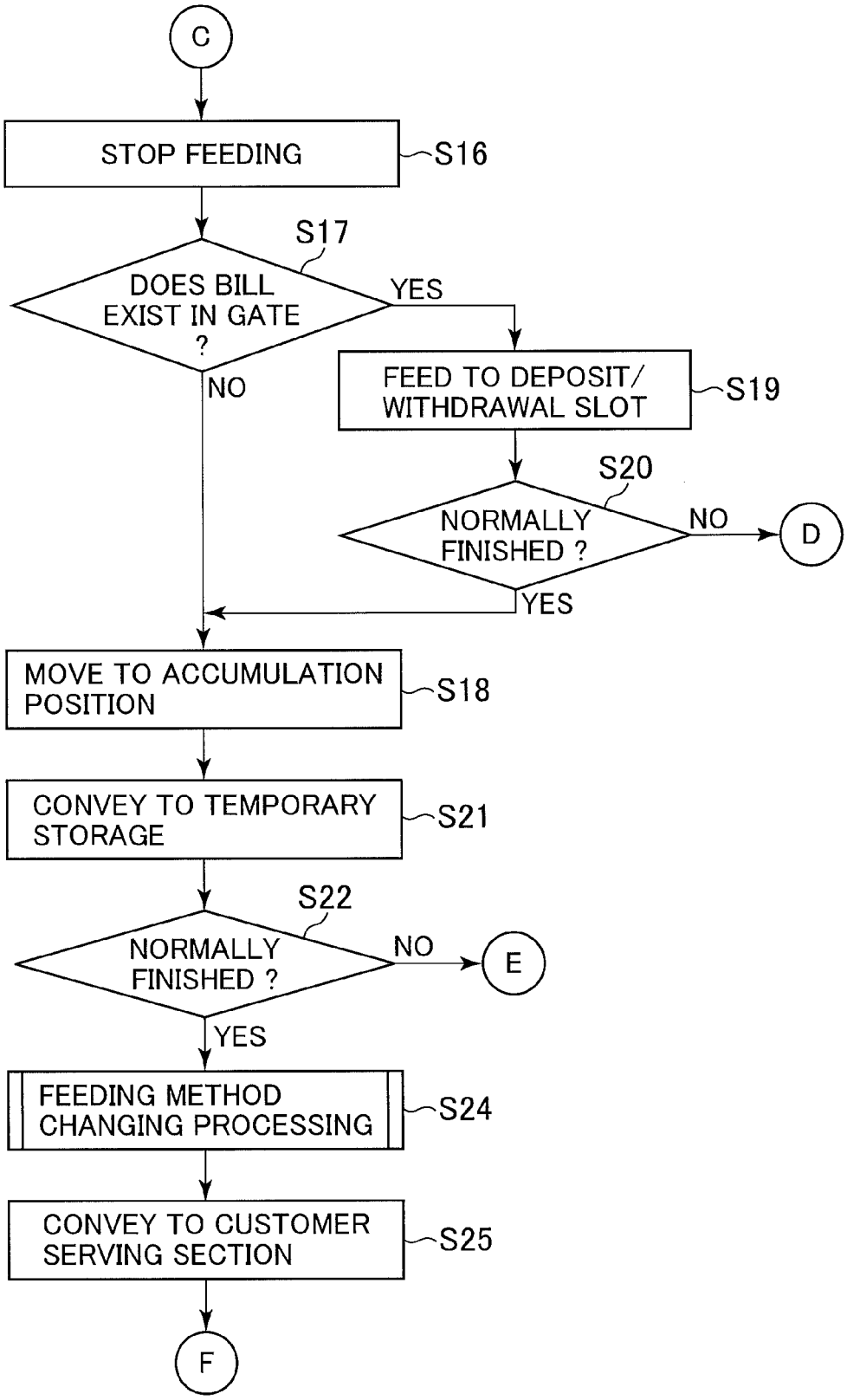
FIG. 6C is a flow chart showing an operational procedure, following FIG. 6A, for conveying the abnormal bill to the customer serving section.

Next, a case where "abnormal discrimination" occurs in step S7 (YES) will be described with reference to FIGS. 6C, 9 and 10.

Figure 10:
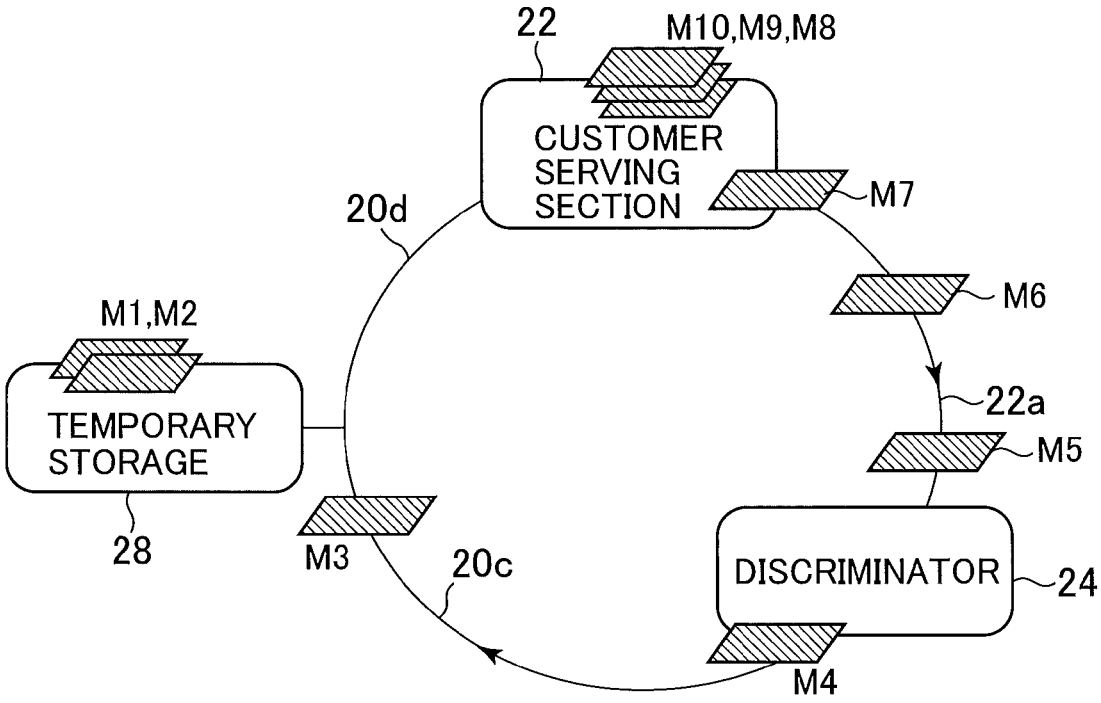
FIG. 10 is an explanatory view showing the position of bills when the bills are fed from the customer serving section in continuous supply in the embodiment shown in FIG. 1.

In the example shown in FIGS. 9 and 10, ten bills M1 to M10 are inserted into the deposit/withdrawal slot 39 and the bills M4 and M8 are abnormal bills. In FIG. 9, letters A to E denote the positions of the bills in the depositing/withdrawing machine 10. The letter A denotes the deposit/withdrawal slot 39; B denotes the conveyance channel 20*a*; C denotes the discriminator 24; D denotes the conveyance channel 20*b*; and E denotes the temporary storage 28. In the example shown in FIG. 9, the deposit process proceeds in the order of steps T0 to T16. Accordingly, FIG. 9 shows the positions of the bills in steps T0 to T16. FIG. 9 also shows the order of the bills at those components. For example, in step T0, FIG. 9, the bills M1 to M10 are aligned in the deposit/withdrawal slot 39 in the order of M1 to M10 from the side of the feeder. In the example, the bills M1 to M10 have respective serial numbers N1 to N10.

FIG. 10 shows how the bills are fed from the deposit/withdrawal slot 39 to the conveyance channel 20*a* in the order of M1 to M10 according to the continuous feeding and the abnormal bill M4 reaches the discriminator 24. At this time, there exist the normal bills M1 and M2 in the temporary storage 28, the bill M3 on the conveyance channel 20*c*, the bill M4 in the discriminator 24, the bills M5 and M6 on the conveyance channel 20*a*, the bill M7 being fed in the feeder, and the bills M8 to M10 in the deposit/withdrawal slot 39 (step T1, FIG. 9).

In step S7, if the bill M4 in the discriminator 24 is detected as abnormal one (YES), the feeder 50 stops feeding the bills (step S16).

The controller 18 determines whether or not the bill being fed exists in the gate 67 in dependent on the presence or absence of the output of the sensor 80 (step S17).

Figure 14:
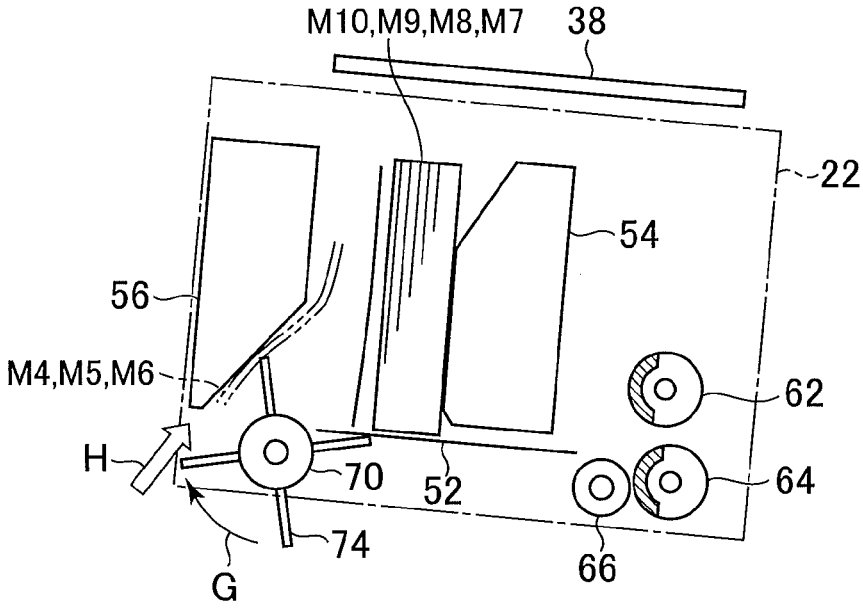
FIG. 14 is a side sectional view of the customer serving section for use in describing operations, following FIG. 11, of the customer serving section when bills are taken from the conveyance channel into the customer serving section.

If there is no bill in the gate 67 in step S17 (NO), the pool guide 54 and bill press 56 are moved to the accumulation positions thereof (step S18). The "accumulation position" is the position which the pool guide 54 or bill press 56 takes when the accumulator 60 takes the bills into the deposit/withdrawal slot 39, which have been conveyed on the conveyance channel 20*d* to the customer serving section 10, as shown in FIG. 14. In the instant embodiment, the pool guide 54 moves up to the insertion position of the pool guide or to a position closer to the accumulation roller 70 than the insertion position. The bill press 56 moves to a position aligned with the pressure roller.

On the other hand, in the example shown in FIG. 10, the bill M7 exists in the gate 67 (YES), and hence the feed roller 64 and separating roller 66 are rotated a predetermined number of times in the direction of the arrow D in FIG. 8, so that the bill M7 existing in the gate 67 will be returned to the deposit/withdrawal slot 39 to be stacked on the pile of bills M8, M9 and M10 in the deposit/withdrawal slot 39 (step S19). Further, in response to the information of the sensor 80, the number of revolutions of these rollers in the direction of the arrow D may be increased.

Based on the sensing result of the sensor 80, it is determined whether or not the process for returning the bill M7 to the deposit/withdrawal slot 39 has successfully completed (step S20).

Figure 11:
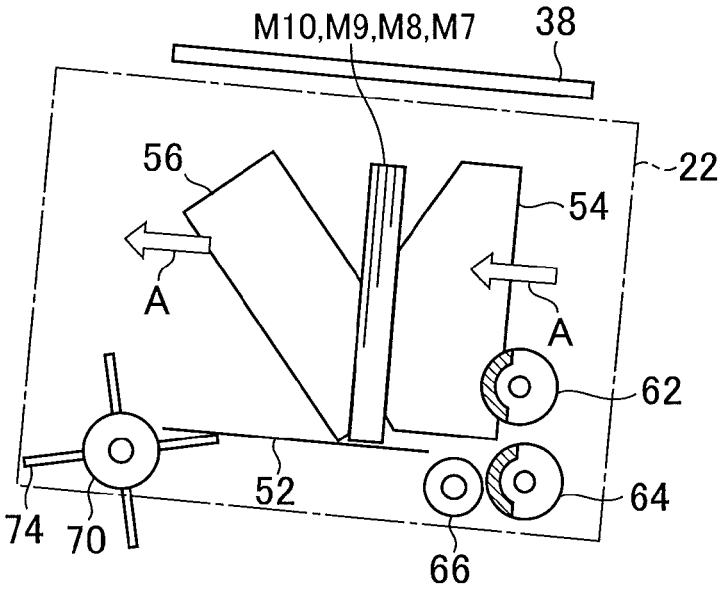
FIG. 11 is a side sectional view of the customer serving section for use in describing operations of the customer serving section when an abnormal bill is detected in the embodiment shown in FIG. 1.

If it is determined that the bill M7 has returned to the deposit/withdrawal slot 39 in step S20 (YES), the pool guide 54 and bill press 56 are moved to the accumulation positions thereof (step S18). In step S18, the pool guide 54 and bill press 56 move toward the accumulation roller 70 with the four bills M7, M8, M9 and M10 nipped as shown in FIG. 11, and will stop at the respective accumulation positions. A detecting means, not shown, determines whether or not the pool guide 54 and bill press 56 have completely moved.

Note that, in step S18, before the pool guide 54 and bill press 56 are moved, the roller in the feeder 50 may be rotated in the direction of the arrow D. Because, in general, if the bills were continuously fed by the feeder 50, a bill adjacent to the bill to be fed to the deposit/withdrawal slot 39 would also be dragged together to the immediate vicinity of the feed roller and separating roller. Under the latter circumstance, if the pool guide 54 and bill press 56 were moved, the dragged bill would prevent the pool guide 54 and bill press 56 from moving.

In step S18, after, or in parallel with, the movements of the pool guide 54 and bill press 56, the bills M3, M4, M5 and M6 on the conveyance channel 20*a*, 20*b* and 20*c* are conveyed to the temporary storage 28 (step S21). That causes the bills M1 to M6 to be stored in the temporary storage 28 in the order of M1, M2, M3, M4, M5 and M6 (step T2, FIG. 9).

Note that, in step S21, the bills M4, M5 and M6 may be returned to the deposit/withdrawal slot 39 rather than being conveyed to the temporary storage 28.

After step S21 where the bills M3 to M6 are conveyed to the temporary storage 28, it is determined whether or not the bills have successfully been conveyed (step S22). In the embodiment, if a detection sensor, not shown, fails to sense a bill remaining on the conveyance channels, it is then determined that the bills M3, M4, M5, M6 have been stored in the temporary storage 28 (YES). If the detection sensor senses some bills remaining on any conveyance channel, it is determined that the conveyance is not successfully finished (NO).

Figure 6D:
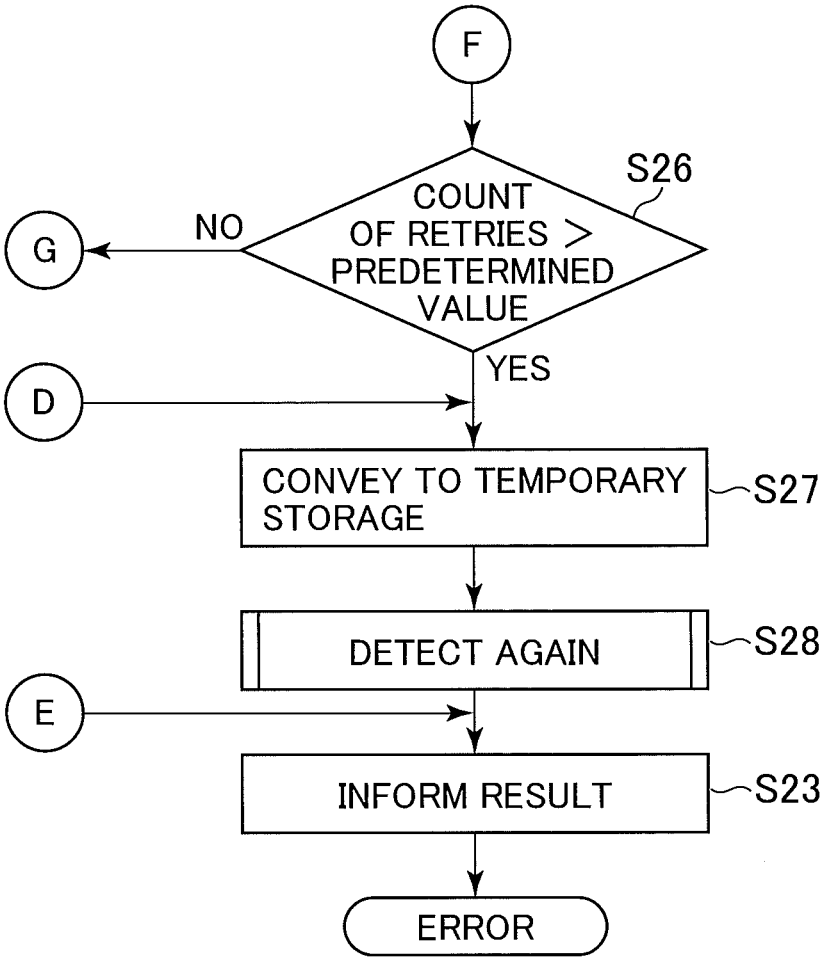
FIG. 6D is a flow chart showing an operational procedure, following FIG. 6C, for displaying a process result on an operation display.

In step S22, if it is determined that transfer is not successfully finished (NO), an error is displayed on the operation display 16 (step S23, FIG. 6D). If it is determined that transfer is successfully finished (YES), the feeding manner of the feeder is changed appropriately (step S24).

Figure 12:
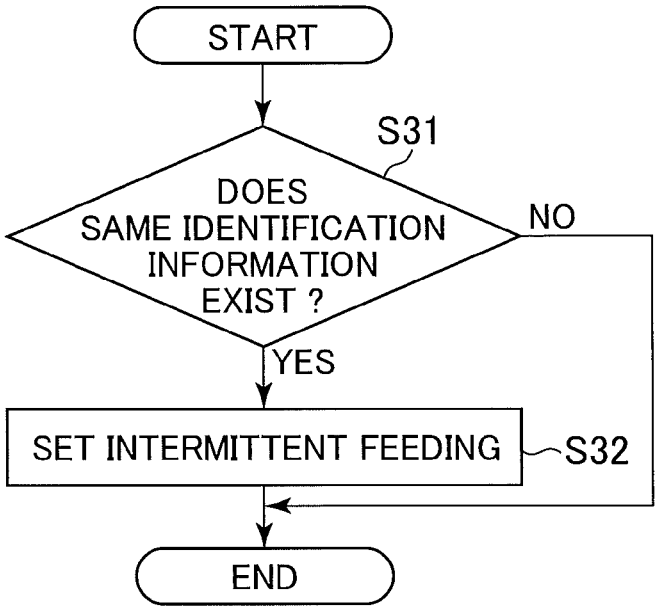
FIG. 12 is a flow chart showing a feeding manner changing process in the embodiment shown in FIG. 1.

Now, processes in step S24 will be described in more detail with reference to FIG. 12.

Figure 13:
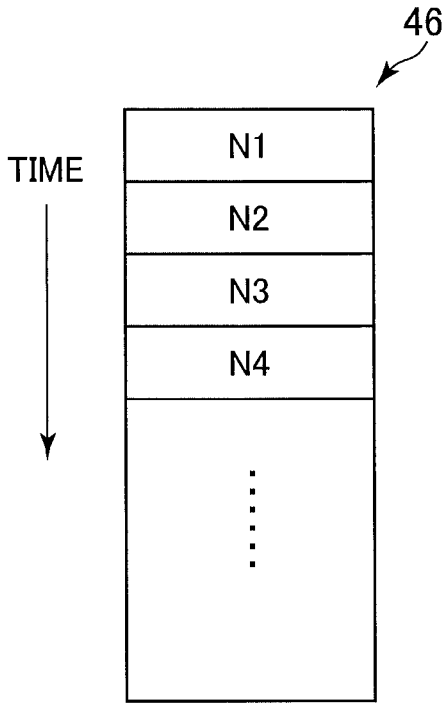
FIG. 13 is a view showing an example of an identification information storage area where serial numbers are stored in the embodiment shown in FIG. 1.

The controller 18 extracts the latest serial number from the storage area 46 and scans the top through final locations of the storage area 46 to find out a serial number identical to the latest serial number except that latest serial number (step S31). For example, according to step T2, FIG. 9, the serial numbers N1 to N4 of the bills M1 to M4 are stored in the storage area 46 in the order acquired by the discriminator as shown in FIG. 13 so that the latest serial number is the serial number N4 stored fourth in the storage area 46. It is determined whether or not the same serial number as that serial number is stored in the storage area 46 earlier than the latest serial number.

In the example shown in FIG. 13, the same serial number as the latest serial number N4 does not exist among the first to third serial numbers stored in the storage area 46 (NO). In this case, the controller 18 does not change the feeding information stored in the memory 26 but finishes the process of step S24.

By contrast, if the same serial number as the latest serial number N4 is stored earlier than the latest serial number (YES), then the controller 18 changes the feeding information in the memory 26 from the "continuous feeding" to the "intermittent feeding" (step S32).

Note that when the feeding information in the storage area 46 has been already changed to the "intermittent feeding", the process of step S24 is not proceeded to.

Following step S24, the abnormal bill M4 and the bills M5, M6 are conveyed to the deposit/withdrawal slot 39 (step S25). At this time, from the temporary storage 28, the bills are conveyed to the customer serving section 22 in a first-in/first-out order, that is, in the order of M6, M5 and M4. They are taken into the deposit/withdrawal slot 39 by the accumulator 60 as shown in FIG. 10, and stacked on the pile of bills M7, M8, M9 and M10. At this time, the bills in the deposit/withdrawal slot 39 are aligned in the order of M7, M8, M9, M10, M6, M5 and M4 from the side of the feeder 50 (step T3, FIG. 9).

Note that when the bills M4, M5 and M6 are returned to the deposit/withdrawal slot 39 in step S21, the process of step S25 is not proceeded to.

When the bills M4, M5 and M6 are returned to the deposit/withdrawal slot 39, the controller 18 adds a unity to the count of retries stored in the memory 26. The count of retries refers to the number of times which the feeder 50 stops feeding bills for step S16, and its initial value is null. Accordingly, in step T3 in FIG. 9, the count of retries is one.

The controller 18 determines whether or not the count of retries exceeds the predetermined value (step S26). The predetermined value may be any value, and in this embodiment is five.

Figure 15:
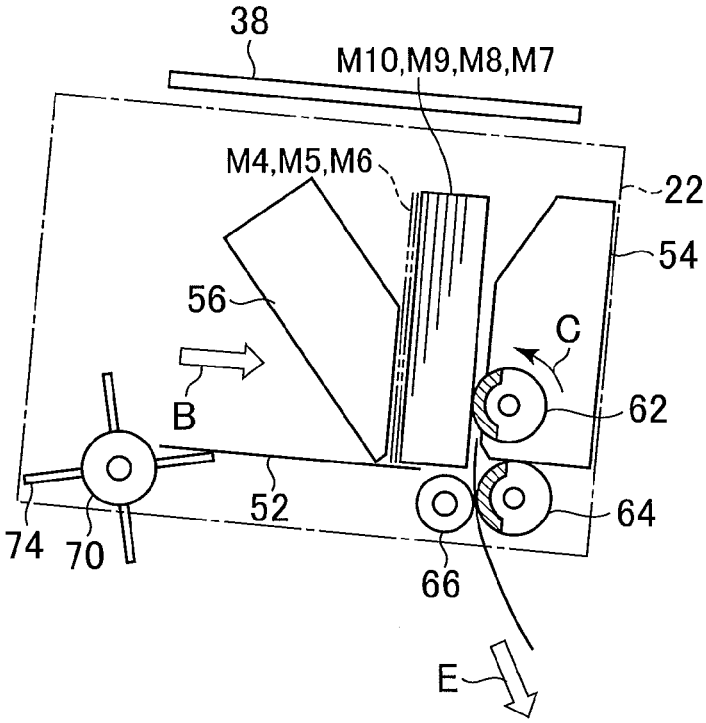
FIG. 15 is a side sectional view of the customer serving section for use in describing operations, following FIG. 14, of the customer serving section when bills are fed from the customer serving section to the conveyance channel; area in the example shown in FIG. 13.

If the count of retries does not exceed the predetermined value (NO), the pool guide 54 and bill press 56 are moved to the feeding position as shown in FIG. 15 (step S3), and the feeding of bills is restarted from the feeder 50 to the conveyance channel 20*a*. Then, the process of step S3 and subsequent steps will be repeated until the count of retries exceeds the predetermined value.

Figure 16:
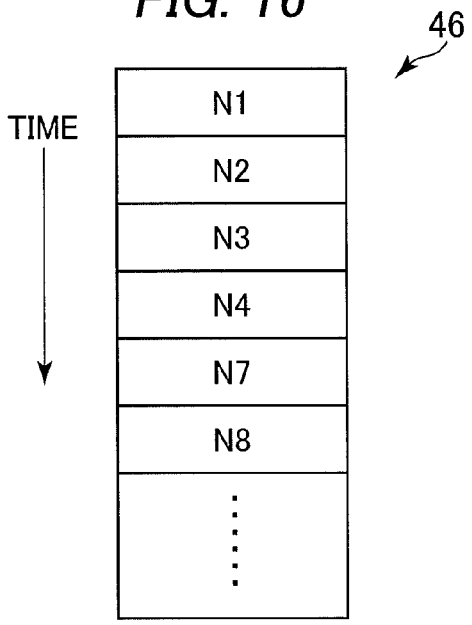
FIGS. 16 and 17 are views for use in describing a storage of serial numbers in the identification information storage area in the example shown in FIG. 13.
Figure 17:
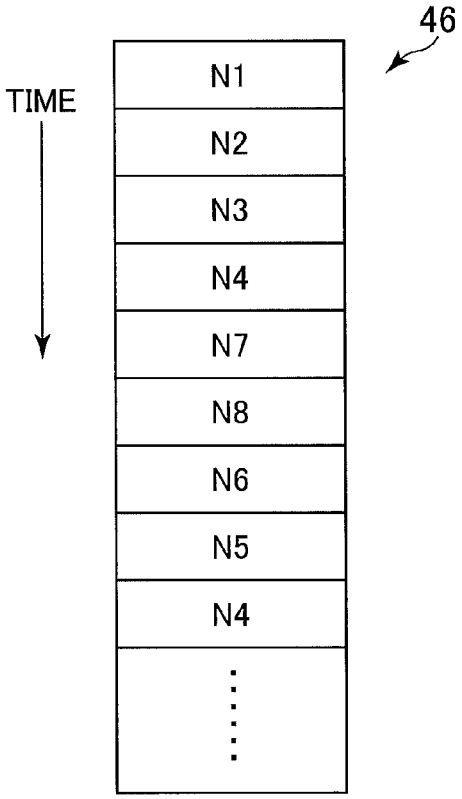

In the example shown in FIG. 9, following the step T3, the bills in the deposit/withdrawal slot 39 are sequentially fed to the conveyance channel 20*a*, beginning from the bill M7, according to the continuous feeding. When the bill M8 reaches the discriminator 24 (step T4, FIG. 9), the bill M8 is detected as the abnormal bill in step S7 (YES), and the bills M7, M8, M9 and M10 are stored in the temporary storage 28 in step S21 (step T5, FIG. 9). At this time, since, as shown in FIG. 16, the same serial number as the serial number N8 of the bill M8, except the latest serial number, is not stored in the storage area 46, the feeding information in the memory 26 is not changed from the "continuous feeding" to the "intermittent feeding" in step S31 but the bills M10, M9 and M8 are returned to the deposit/withdrawal slot 39 in step S25 (step T6, FIG. 9). At this time, the count of retries is incremented to two so that it is determined that the count of retries does not exceed the predetermined value in step S26 (OK), and the procedure returns to step S4 where the bills are fed from the feeder 50 to the conveyance channel 20*a* according to the continuous feeding. As a result, when the bill M4 reaches the discriminator 24 (step T7, FIG. 9), the bill M4 is detected as abnormal one in step S7 so that the bills M5, M4, M10, M9 are stored in the temporary storage 28 in step S21 (step T8, FIG. 9), and the process of step S24 is performed. At this time, the storage area 46 has the serial numbers stored as shown in FIG. 17. Accordingly, it is determined that the same serial number as the serial number of the bill M4, but the latest serial number, is already stored in the storage area 46 in step S31 (YES), so that the feeding information of the memory 26 is switched to the "intermittent feeding" in step S32.

The bills M9, M10 and M4 are returned to the deposit/withdrawal slot 39 in step S25 (step T9, FIG. 9) so that, the count of retries is incremented by one to become three.

Thereafter, the procedure returns to step S4 where the feeder 50 starts feeding the bills. At this time, since the feeding information 48 in the memory 26 is the "intermittent feeding", the bills in the deposit/withdrawal slot 39 are fed to the conveyance channel 20*a* according to the intermittent feeding. Accordingly, while the bill M8 is discriminated by the discriminator 24, the bills M9, M10 and M4 are in the deposit/withdrawal slot 39 (step T10, FIG. 9).

The bill M8 is detected as abnormal one in step S7 so that the bill M8 is returned to the deposit/withdrawal slot 39 in step S25 (step T11, FIG. 9). After the feeding information 48 is once changed to the "intermittent feeding", the processes of steps S21, S22 and S24 may not be performed. The count of retries is incremented by one to be four. The procedure returns to step S4 where the bill M9 is fed from the deposit/withdrawal slot 39 to the discriminator 24 (step T12, FIG. 9).

When the bill M9 is detected as the normal bill in step S7, the bill M9 is stored in the temporary storage 28 in step S8 and the bill M10 is fed from the deposit/withdrawal slot to the discriminator 24 in step S4 (step T13, FIG. 9).

When the bill M10 is detected as normal one in step S7, the bill M10 is stored in the temporary storage 28 in step S89 and the bill M4 is fed from the deposit/withdrawal slot 39 to the discriminator 24 in step S4 (step T14, FIG. 9).

When the bill M4 is detected as a counterfeit bill in step S7, the bill M4 is returned to the deposit/withdrawal slot 39 in step S25 (step T15, FIG. 9) and the count of retries is incremented by one to become five.

When the bill M8 is fed from the deposit/withdrawal slot 39 to the discriminator 24 in step S4 (step T16, FIG. 9) and the bill M8 is detected as the abnormal bill in step S7, the bill M8 is returned to the deposit/withdrawal slot 39 in step S25 and the count of retries is incremented by one to become six.

The count of retries exceeds the set number of times in step S21, and thus the depositing/withdrawing machine 10 performs a predetermined process and thence displays a process result on the operation display 16 (step S23).

The predetermined process in the present embodiment is the same as the process performed when the bill M7 in the gate 67 is not returned to the deposit/withdrawal slot 39 in step S19, which will be described later. As another example of the predetermined process, the bills in the deposit/withdrawal slot 39 may be conveyed to the discriminator 24 to be subjected to more detailed discrimination. In that case, when the detailed discrimination reveals the bill as determined normal by the discriminator, that bill may be stored in the temporary storage 28, and as a result, when no bill exists in the deposit/withdrawal port 39, the procedure may proceed to Step S10.

Figure 18:
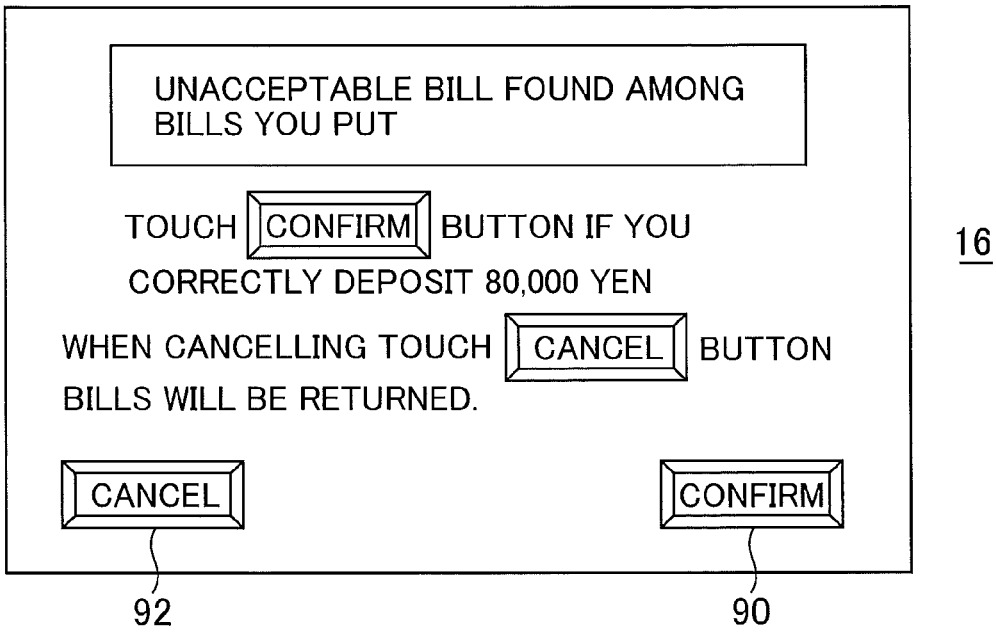
FIG. 18 is a plan view showing an example of a screen displayed on an operation display shown in FIG. 2.
Figure 19:
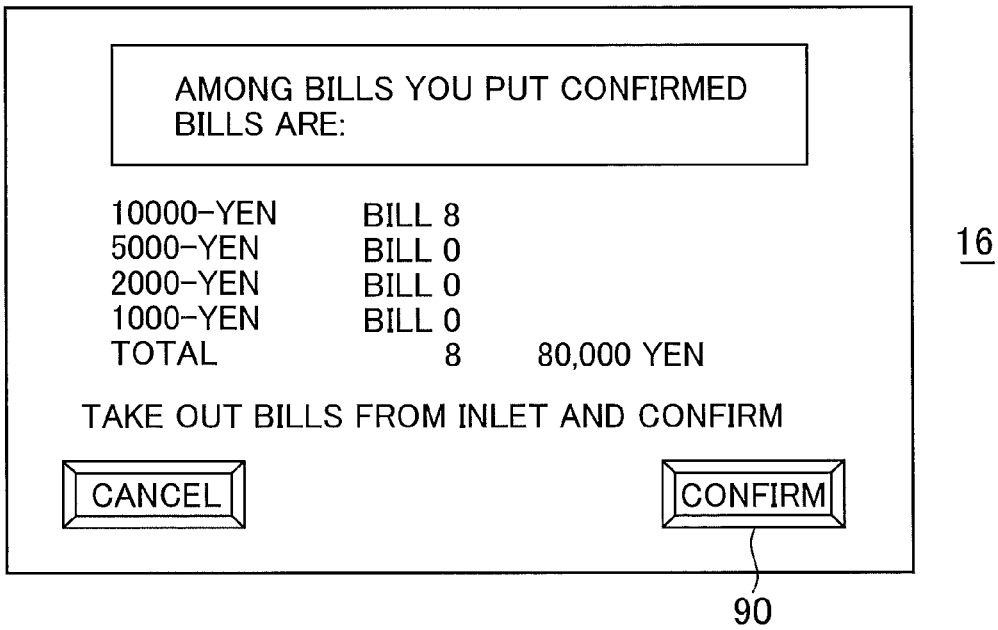
FIG. 19 is a plan view showing an example of a screen displayed on the operation display when a confirmation button is depressed in FIG. 18.

In step S23, the operation display 16 displays, for example, a message "Unacceptable bill found among bills you put" as shown in FIG. 18. That message is caused because an acceptable bill or bills may be found among the bills 40 inserted by the customer. When the bills are confirmed, that is, the customer depresses a confirmation button 90, a corresponding message is accordingly displayed as shown in FIG. 19.

Description will be made on processing taken when it is determined that the process of step S19 is not normally finished in step S20 (NO), that is, the sensor 80 remains sensing a bill even when the feed roller 64 and separating roller 66 rotate the predetermined number of times in the direction of the arrow D in FIG. 8.

Figure 20:
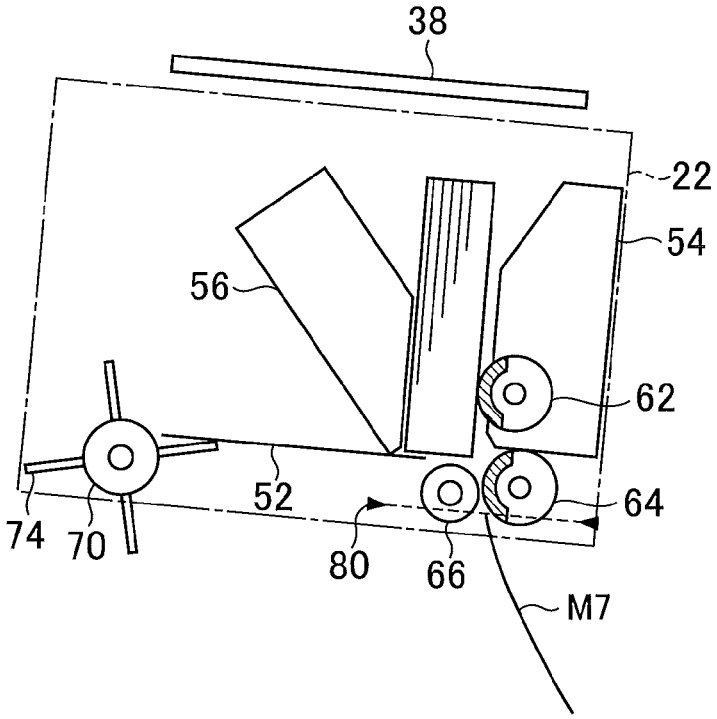
FIG. 20 is aside sectional view of the customer serving section for use in describing the position of a bill when a sensor in a gate in FIG. 4 senses a bill.

If, in step S20, the process of step S19 is not determined as successfully finished, the bill M7 is possibly be jammed in the gate 67. However, the sensor 80 would possibly keep sensing a bill in step S20 although the bill M7 is not jammed in the gate 67. One example is when the bill M7 stays, as shown in FIG. 20, at a sensible position by the sensor 80, but is neither engaged with the feed roller 64 nor the separating roller 66. Under that circumstance, rotation of the feed roller 64 and separating roller 66 in step 19 would not cause the bill M7 to be returned to the deposit/withdrawal slot 39 but the sensor 80 would remain sensing the bill.

In consideration of such a situation, the instant embodiment is adapted such that, following the determination in step S20 (NO), the bill M3 on the conveyance channels 20*b* and 20*c* and the bill M4 on the discriminator 24, as well as the bills M5 and M6 on the conveyance channel 20*a* are conveyed to the temporary storage 28 to be stored therein (step S27), and it is then determined whether or not there is any bill in the gate 67 by means of the sensor 80 (step S28). This can avoid a situation that would have to be addressed by the clerk.

Figure 21:
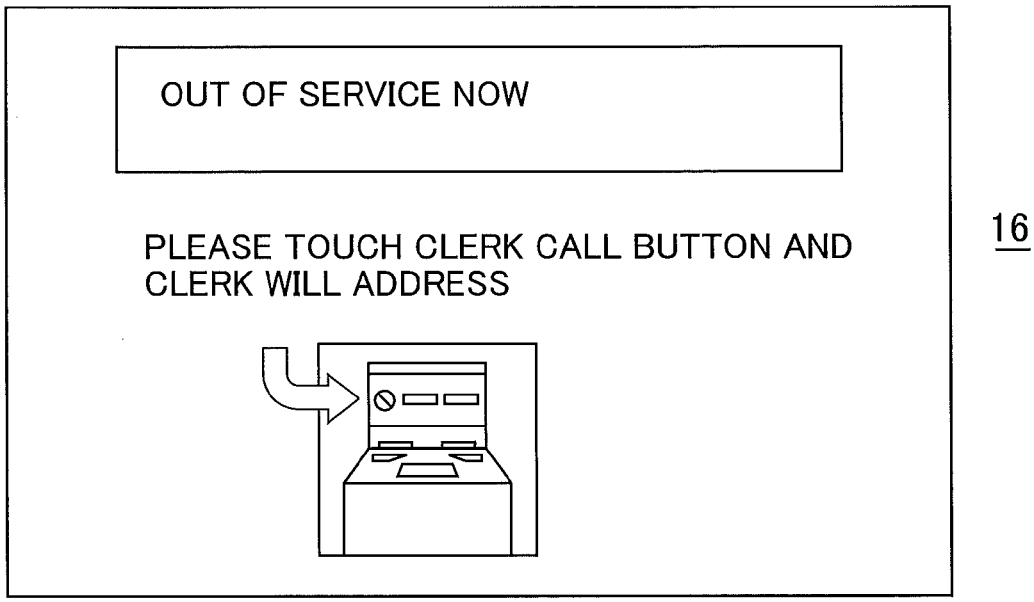
FIG. 21 is a plan view showing an example of a screen displayed on the operation display shown in FIG. 2 at the time when the depositing/withdrawing machine cannot perform the deposit process.

If the sensor 80 senses a bill in step S28, the operation display 16 displays that the depositing/withdrawing machine 10 interrupts the service of bills (step S23) as shown in FIG. 21. Subsequent operations will be proceeded to by the clerk of the depositing/withdrawing machine.

The clerk takes out the bills M8, M9 and M10 in the deposit/withdrawal slot 39, and the bill M7 in the gate 67 as well as the bills M1 to M6 stored in the temporary storage 28, and returns the bills to the customer, for example.

If the sensor 80 fails to sense any bill in step S28 (YES), it is determined that the process for returning the bills in the gate 67 to the deposit/withdrawal slot 39 is successfully completed so that the procedure may proceed to step S18.

Now, with reference to FIG. 22, it will be described how the embodiment shown in FIG. 10 shifts the bills M1 to M10 in position in the depositing/withdrawing machine 10 in step 21 when the bills in the discriminator 24 and conveyance channel 20*a* are returned from the discriminator 24 directly to the deposit/withdrawal slot 39.

First, the bills M1 to M10 are placed in the deposit/withdrawal slot 39 (step T0). The bills in the deposit/withdrawal slot 30 are fed to the discriminator 24, beginning from the bill M1, by the feeder according to the continuous feeding. When the bill M4 reaches the discriminator 24, there are the bills M1 and M2 in the temporary storage 28, the bill M3 on the conveyance channel 20*c*, the bills M5 and M6 on the conveyance channel 20*a*, and the bills M7 to M10 in the deposit/withdrawal slot (step T1).

When the bill M4 is detected as abnormal one, the bill M3 is stored in the temporary storage 28 and the bills M4 to M6 are returned to the deposit/withdrawal slot 39. At this time, the bills in the deposit/withdrawal slot 39 are aligned in the order of M7, M8, M9, M10, M4, M5 and M6 from the side of the feeder 50 (step T2). The count of retries is incremented to one.

The bills in the deposit/withdrawal slot 39 are fed to the conveyance channel 20*a*, beginning from the bill M7, according to the continuous feeding and the bill M8 reaches the discriminator 24 (step T3).

When the bill M8 is detected as abnormal one, the bill M7 is stored in the temporary storage 28 and the bills M8 to M10 are conveyed to the deposit/withdrawal slot 39 (step T4). The count of retries is incremented by one to become two.

Beginning from the bill M4, the bills in the deposit/withdrawal slot 39 are fed to the conveyance channel 20*a* according to the continuous feeding and the bill M4 reaches the discriminator 24 again (step T5).

When the bill M4 is detected as abnormal one, the feeding information in the memory 26 is changed from the "continuous feeding" to the "intermittent feeding". Then, the bills M4 to M6 are conveyed to the deposit/withdrawal slot 39 (step T6). The count of retries is incremented by one to be three.

When the bill M8 is fed from the deposit/withdrawal slot 39 to the discriminator 24 (step T7) and the bill M8 is detected as abnormal one, the bill M8 is returned to the deposit/withdrawal slot 39 (step T8). The count of retries is incremented by one to be four.

When the bill M9 is fed to the discriminator 24 (step T9) and the bill M9 is detected as normal one, the bill M9 is stored in the temporary storage 28 and the bill M10 is fed to the discriminator 24 (step T10).

When the bill M10 is determined as normal one, the bill M10 is stored in the temporary storage 28 and the bill M4 is fed to the discriminator 24 (step T11).

When the bill M4 is determined as abnormal one, the bill M4 is returned to the deposit/withdrawal slot 39 (step T12). The count of retries is incremented by one to become five.

When the bill M5 is fed to the discriminator 24 (step T13) and is determined as normal one, the bill M5 is stored in the temporary storage 28 and the bill M6 is fed to the discriminator 24 (step T14).

When the bill M6 is determined as normal, the bill M6 is stored in the temporary storage 28 and the bill M8 is fed to the discriminator 24 (step T15).

When the bill M8 is determined as abnormal, the count of retries increments to six.

Since the count of retries exceeds the predetermined value, the depositing/withdrawing machine 10 performs the predetermined process to display the process result on the operation display 16 (step S23, FIG. 6D).

In the present embodiment, it is possible to differentiate the bills inserted into the deposit/withdrawal slot and never been sent to the conveyance section from the bills determined as abnormal by the discriminator and returned to the deposit/withdrawal slot. Also, after all of the bills inserted in the deposit/withdrawal slot have passed the discriminator according to the continuous feeding, it is possible to switch the bill feeding manner of the feeder from the continuous feeding to the intermittent feeding, thereby preventing bills from remaining undiscriminated and performing the deposit process within a shorter period of time.

In an alternative embodiment of the present invention, the identification information may be what is indicative of the characteristic of bills other than the serial number and may be information including. For example, from bill image data acquired by the discriminator, characteristics such as bending, wrinkles, smear, breaking, cut, or characters or figures (scribbles) scribbled by someone, and information on the position of such characteristics on a bill (the coordinates and front or back surface of the bill) may be obtained as bill identification information, which is processed in step S24, FIG. 6C to switch the feeding manner of the feeder from the continuous feeding to the intermittent feeding. In that case, in step S6, the identification information of each bill is stored in the storage area 46 and, in step S31, FIG. 12, it is determined whether or not the same identification information as the latest identification information is previously stored in the storage area 46 earlier than the latest identification information is stored, so that, if the same identification information is stored, the feeding manner is switched to the intermittent feeding.

Thus, even when the discriminator 24 cannot read the serial number, it is possible to differentiate the bills inserted from the deposit/withdrawal slot 39 and not fed to the conveyance channel 20*a* from the bills determined as abnormal by the discriminator 24 and returned to the deposit/withdrawal slot 39.

Further, even when a plurality of counterfeit bills having the same serial number are inserted into the deposit/withdrawal slot 39, it is possible to distinguish the bills inserted from the deposit/withdrawal slot 39 and not fed to the conveyance channel 20*a* from the bills determined as abnormal by the discriminator 24 and returned to the deposit/withdrawal slot 39.

Note that, in the embodiment shown in FIG. 1, the process in step S24, FIG. 6D is performed by the controller. However, the process may be performed by the discriminator having a storage.

The present invention can be applied to the depositing/withdrawing machine as well as devices that discriminate kinds of media other than bills.

The entire disclosure of Japanese patent application No. 2010-231655 filed on Oct. 14, 2010, including the specification, claims, accompanying drawings and abstract of the disclosure, is incorporated herein by reference in its entirety.

While the present invention has been described with reference to the particular illustrative embodiment, it is not to be restricted by the embodiment. It is to be appreciated that those skilled in the art can change or modify the embodiment without departing from the scope and spirit of the present invention.

The invention claimed is:

1. A bill depositing/withdrawing machine comprising:

a bill inlet section into which a bill is insertable;

a bill conveyance channel connected to the bill inlet section;

a feeder configured to feed bills one by one, in either a continuous feeding mode or an intermittent feeding mode, from said bill inlet section to the bill conveyance channel;

a discriminator configured to discriminate the bills conveyed by the bill conveyance channel;

an accumulator configured to accumulate the bills conveyed to said bill inlet section;

an identification information reader configured to read identification information of each of the bills discriminated by said discriminator;

an identification information storage configured to store the read identification information; and a controller configured to determine, upon detection of an abnormal bill by the discriminator, whether or not the identification information of the abnormal bill is already stored in said identification information storage, and if the identification information of the abnormal bill is already stored, to cause said feeder to switch from the continuous feeding mode to the intermittent feeding mode, after undiscriminated ones of the bills in said bill conveyance channel are returned to said bill inlet section with the abnormal bill, wherein the feeder is configured to feed, when working in the intermittent feeding mode, a bill from said inlet section to said conveyance channel after an immediately preceding bill fed from said bill inlet section to said conveyance channel is discriminated by said discriminator.

2. The bill depositing/withdrawing machine in accordance with claim 1, wherein the identification information is a serial number printed in advance on each of the bills.

3. The bill depositing/withdrawing machine in accordance with claim 1, wherein the identification information is characteristic information of each of the bills.

4. The bill depositing/withdrawing machine in accordance with claim 3, wherein the characteristic information of said each bill includes at least one of a written character or figure, and information on a position of the character or the figure on said each bill, which are extracted from image data of said each bill acquired by said discriminator.

5. A bill depositing/withdrawing machine comprising:

a bill inlet section into which a bill is insertable;

a bill conveyance channel connected to the bill inlet section;

a feeder configured to feed bills one by one, in either a continuous feeding mode or an intermittent feeding mode, from said bill inlet section to the bill conveyance channel;

a discriminator configured to discriminate the bills conveyed by the bill conveyance channel;

an accumulator configured to accumulate the bills conveyed to said bill inlet section; and a controller configured to cause, upon detection of an abnormal bill by the discriminator, the feeder to switch from the continuous feeding mode to the intermittent feeding mode.

* * * * *